US008430248B2

(12) United States Patent
Malmberg

(10) Patent No.: US 8,430,248 B2
(45) Date of Patent: Apr. 30, 2013

(54) VIBRATING SCREEN DEVICE HAVING MODULAR SCREENING MEDIA

(75) Inventor: Mats Malmberg, Rydsgård (SE)

(73) Assignee: Sandvik Intellectual Property AB, Sandviken (SE)

( * ) Notice: Subject to any disclaimer, the term of this patent is extended or adjusted under 35 U.S.C. 154(b) by 170 days.

(21) Appl. No.: 13/034,196

(22) Filed: Feb. 24, 2011

(65) Prior Publication Data

US 2011/0215032 A1 Sep. 8, 2011

(30) Foreign Application Priority Data

Mar. 3, 2010 (SE) ..... 1050201

(51) Int. Cl.
*B07B 1/46* (2006.01)

(52) U.S. Cl.
USPC ..... 209/405; 209/409

(58) Field of Classification Search ..... 209/319, 209/405, 408, 409
See application file for complete search history.

(56) References Cited

U.S. PATENT DOCUMENTS

| | | | | |
|---|---|---|---|---|
| 3,624,867 | A * | 12/1971 | Reynolds | 29/413 |
| 4,670,136 | A * | 6/1987 | Schmidt et al. | 209/403 |
| 5,755,334 | A * | 5/1998 | Wojcik et al. | 209/399 |
| 6,253,926 | B1 * | 7/2001 | Woodgate | 209/399 |
| RE38,303 | E * | 11/2003 | Askew | 209/405 |
| 7,654,394 | B2 * | 2/2010 | LaVeine et al. | 209/310 |
| 8,025,153 | B2 * | 9/2011 | Freissle et al. | 209/399 |
| 2005/0274653 | A1 * | 12/2005 | LaVeine et al. | 209/310 |
| 2010/0282649 | A1 * | 11/2010 | Angus | 209/409 |

FOREIGN PATENT DOCUMENTS

| | | | |
|---|---|---|---|
| WO | WO 02/49777 | A1 | 6/2002 |
| WO | WO 2005/077551 | A1 | 8/2005 |
| WO | WO 2005/123278 | A2 | 12/2005 |
| WO | WO 2009/089578 | A1 | 7/2009 |

OTHER PUBLICATIONS

International Search Report from corresponding International Application No. PCT/SE2011/050072 as filed on Jan. 25, 2011, dated Jun. 7, 2011; 4 pages.

Search Report from corresponding Swedish Application No. 1050201-1 as filed on Mar. 3, 2010, dated Aug. 31, 2010; (in Swedish language only), 6 pages.

* cited by examiner

*Primary Examiner* — Joseph C Rodriguez
(74) *Attorney, Agent, or Firm* — Morgan, Lewis & Bockius LLP

(57) ABSTRACT

A vibrating screen device for fractionizing stones and gravel includes a support structure, a plurality of carriers mounted on the support structure, and a plurality of screening mats removably mounted on the carriers in side-by-side relationship. Each carrier includes two upright beams forming a slot therebetween. Each screening mat has opposite end parts, wherein respective end parts of two adjacent screening mats are received in each slot. The beams and end parts include protrusions and grooves which are interconnected, and maintained in connection, by a wedge inserted into the slot between the end parts.

17 Claims, 2 Drawing Sheets

VIBRATING SCREEN DEVICE HAVING MODULAR SCREENING MEDIA

RELATED APPLICATION DATA

This application claims priority under 35 U.S.C. §119 and/or §365 to Swedish Application No. 1050201-1, filed Mar. 3, 2010, the entire contents of which are incorporated herein by reference

TECHNICAL FIELD

The present disclosure concerns a vibrating screen device having screening media in the form of a number of parallel screening mats.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

In vibrating screen devices used for fractionation of, for example, crushed stones and gravel into fractions of stones with different sizes, screening media are used having screening apertures for allowing stones smaller than the screening apertures to pass therethrough. The screening media is placed on some kind of support structure, normally having the form of a grid. The screening media is a wearing part which is replaced from time to time. For many vibrating screen devices the screening media has the form of modules, including a support structure for the screening mat. When replacing the screening media the entire module is replaced. Thus, complete modules have to be stored and transported

SUMMARY

One object of the preferred disclosure is to be able to use the same screening mat independently of the design and make of the vibrating screen device. The dimensions of the screening mats are adapted to the actual vibrating screen device.

In the preferred embodiment, existing vibrating screen devices are retrofit by mounting thereon carriers for screening mats. The carriers are adapted to the design of the support structure of the existing vibrating screen device. However, the part of each carrier to receive the screening mats is the same and independent of the design of the vibrating screen device. The same type of screening mat is used independently of the design of the vibrating screen device.

The screening mats are removably mounted on the carriers in side-by-side relationship, each screening mat having opposite end parts, wherein respective end parts of two adjacent screening mats are received in each carrier. Preferably, each carrier has a lengthwise direction and includes two upright beams extending in said lengthwise direction and forming a slot. Respective end parts of two adjacent screening mats are disposed in the slot.

Preferably, each of the beams includes a plurality of protrusions and grooves, wherein each of the end parts disposed in the slot includes a plurality of protrusions and grooves connected to the grooves and protrusions, respectively, of the beams.

The screening mats are cut into appropriate lengths before being mounted in the vibrating screen device. Since the screening mats may be cut into suitable lengths just before mounting, the screening media could be stored and transported in a state rolled into a coil or in long lengths. Normally the carriers are not replaced when worn screening mats are replaced with new screening mats. Thus, compared to the previous systems, as indicated above, where the screening media is placed on a support to form a module, the handling of the screening media, such as transportation, storing and installation thereof, is simplified.

Furthermore, mounting of the screening mats in the vibrating screen device is performed in an easy, yet reliable way, without any penetrating fastening means.

In the description the expressions "lower", "upper" and similar expressions are in view of the directions as shown in the figures and as normally used.

Further objects and advantages of the present invention will be obvious to a person skilled in the art when reading the detailed description below of the preferred embodiment.

It is to be understood that both the foregoing general description and the following detailed description are exemplary and explanatory and are intended to provide further explanation of the invention as claimed.

BRIEF DESCRIPTION OF THE DRAWING

Preferred embodiments will be described below by way of example and with reference to the enclosed drawings.

DETAILED DESCRIPTION

In a preferred vibrating screen device, carriers 1 are adapted to be received on a conventional support structure. The screening media, in the form of apertured screening mats 2, are placed on top of the carriers and removably fixed thereto, wherein worn screening mats can be replaced without having to replace the carriers or the support structure, as explained below.

Figure 1:
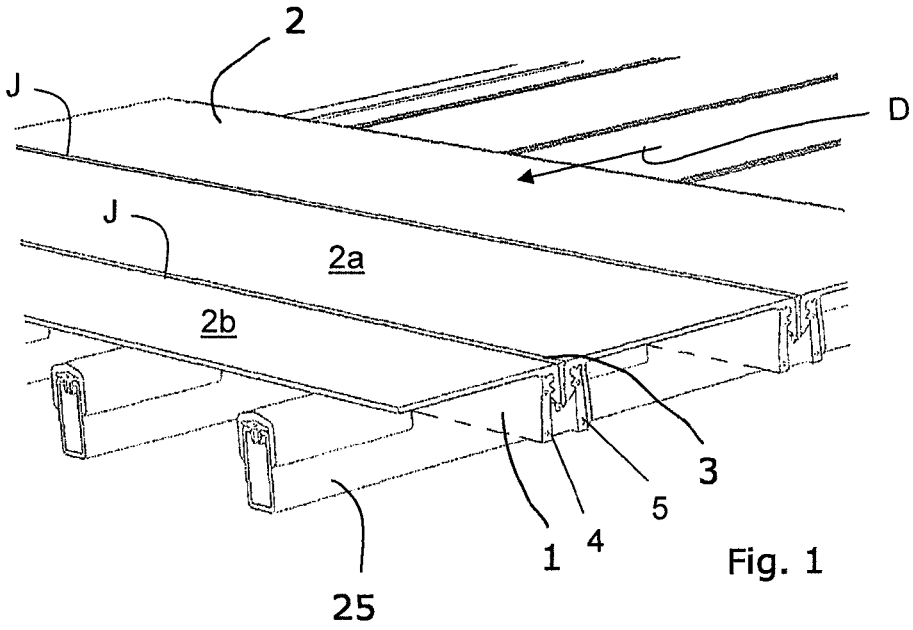
FIG. 1 is a perspective view of a portion of a vibrating screen device, including modular screening media, as seen from the right-hand side of the device.

A plurality of screening mats 2 placed side by side forms the screening deck of the vibrating screen device. The screening mats are depicted in FIG. 1 without the screening apertures being shown. The support structure of a vibrating screen may have many different designs, and often forms a grid. In FIG. 1 a conventional support structure 25 is shown. According to the preferred embodiment of the invention, the carriers 1 are provided to connect the screening mats to the support structure. In that regard, respective ends of two adjacent screening mats 2*a*, 2*b* are received in a slot 6 in the carrier 1, and a wedge 3 is pressed downwardly in the slot between the screening mats 2 in the slot 6. That manner of fixation will be described further below.

The carriers 1 are mounted on the support structure of the vibrating screen device in any suitable way, such as by welding or removable fasteners. Then, screening mats 2 are mounted on the carriers 1 in the manner described below. The screening mats 2 are placed transversally to the direction of travel D of the material on the vibrating screen, such as crushed stones, gravel etc., whereby the joints J between adjacent screening mats 2 also are placed transversally to such direction of travel D. If the joints J were instead oriented in the same direction as the direction of travel D, there would be a risk of some stone/gravel material travelling along said joints J and not becoming properly separated.

Figure 3:
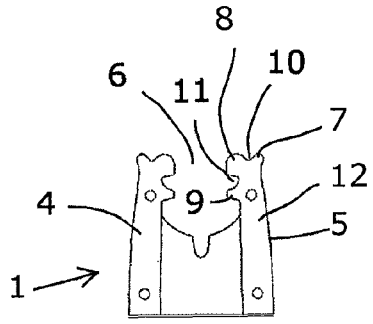
FIG. 3 is a partial view of the carrier of FIG. 2 before screening media has been fixed in place.

The carriers 1 are elongated in the direction transversally to direction D. Each carrier 1 has two upright beams 4, 5, between which the slot 6 is formed. The beams 4, 5 extend the entire length of the carrier 1. The upper part of each beam 4, 5 has a number of protrusions and grooves. Several of the protrusions and grooves are located on the surfaces of the beams 4, 5 facing each other in each carrier 1. Thus, the protrusions and grooves are located on opposite sides of the slot 6 of the carrier 1. At an upper outer corner, as seen in FIG. 3, each beam 4, 5 has an outer protrusion 7, and at an upper inner corner it has an inner protrusion 8. In the upper surface of each beam 4, 5 an upper groove 10 is formed between the inner protrusion 8 and the outer protrusion 7. Each inner protrusion 8 forms both an upper surface of the inner corner and a vertical surface facing the other beam 4, 5 of the carrier 1. At a distance downwards from the inner protrusion 8, a lower protrusion 9 is formed on the surface facing the other beam of the carrier 1. Between the inner protrusion 8 and the lower protrusion 9, an inner groove 11 is formed.

Figure 4:
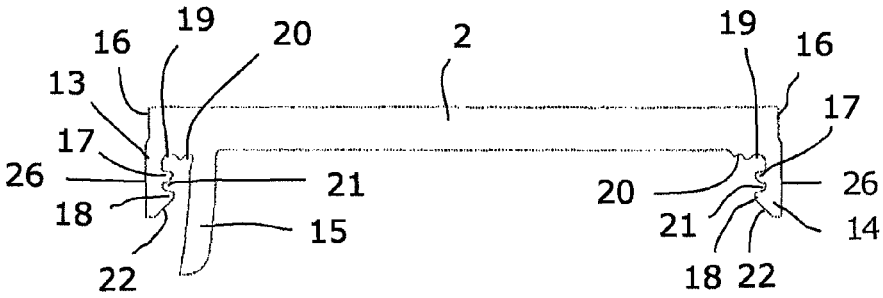
FIG. 4 is an end view of the screening media of FIGS. 1 and 2.

Each screening mat 2 has opposite end parts 13, 14 spaced apart in the direction D of stone/gravel flow (see FIG. 4). The end parts 13, 14 are directed downwards from the screening mat 2. The lower ends of the end parts 13, 14 are chamfered 22 on the sides facing each other. At one end of each screening mat 2, a projection 15 projects downward from the screening mat and is parallel with the end parts 13, 14. The projection 15 is located adjacent the end part 13 in FIG. 4, and the distance between the projection 15 and the adjacent end part 13 is adapted to the thickness of the beam 4, 5 of the carrier 1, which adapted thickness is such that the beam 4, 5 can be received between the projection 15 and the end part 13. The projection 15 is intended to protect an outer surface 12 of the beam 5 of the carrier 1 which is susceptible to being hit by particles coming through the screening mat 2. The outer surface of each end part 13, 14, i.e. the opposite sides of each screening mat 2, is generally vertical with a step formed therein because a lower part 26 of the outer surface extends farther outwardly than an upper part 16 thereof (see FIG. 4). The shapes of said outer surface of the end parts 13, 14 are adapted to the shape of the wedge 3.

The end parts 13, 14 have a number of protrusions and grooves complementary with the protrusions and grooves of the beams 4, 5. Thus, on the inside of each end part 13, 14 of the screening mat 2, and as seen in FIG. 4, there are an upper protrusion 17 and a lower protrusion 18. Between the upper protrusion 17 and the lower protrusion 18, a lower groove 21 is formed. In an inner corner at each end part 13, 14 a corner groove 19 is formed. Adjacent the corner groove 19 a further, inner groove 20 is formed on a horizontal surface. The protrusions 17, 18 and grooves 19-21 of the end parts 13, 14 of the screen mat 2 extend the entire length of the screening mat 2 (i.e., in a direction perpendicular to the direction D of stone/gravel flow).

Figure 5:
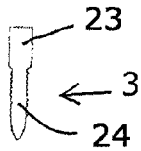
FIG. 5 is an end view of a wedge for securing screening media to the carrier.

The wedge 3 is an elongated, relatively thin part having a length corresponding with the length of the carrier 1 and the screening mat 2. Seen in end view, as in FIG. 5, the wedge 3 has an upper portion 23 which transforms into a lower portion 24 by means of a chamfer, whereby the lower portion 24 is thinner than the upper portion 23. The opposite sides of the lower portion 24 are not smooth, but rather are roughened by a number of horizontal or longitudinal crests. The crests increase the friction between the wedge 3 and the adjacent screening mats and thus assist in keeping the wedge 3 in place between the screening mats 2 after being mounted to the carriers. The lower end of the lower portion 24 of the wedge 3 is pointed. Due to that pointed lower end and the thinner lower portion 24, insertion of the wedge 3 is facilitated, compared to a wedge of constant thickness.

Figure 2:
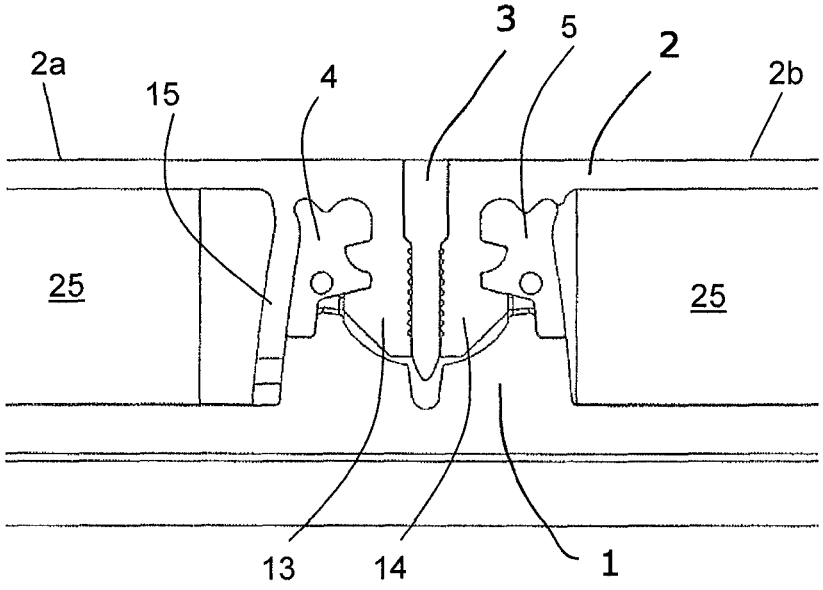
FIG. 2 is an end view through the vibrating screen device, illustrating the manner of fixing the screening media to a carrier as seen from the left-hand side of the device.

In use, either of the end parts 13 or 14 of a first screening mat 2 is placed inside the slot 6 of one carrier 1, and connected to a respective beam 4 or 5 of the carrier 1. The manner of installing the end parts 13 and 14 is identical. For example, in the shown embodiment of FIG. 2, the end part 13 is connected to the beam 4. In particular, the outer protrusion 7 at the outer corner of the beam 4 is received in the inner groove 20 of the end part 13. (It is noted that the screening mat 2*a* shown in FIG. 2 is viewed from its end situated opposite the end from which the mat 2*a* is viewed in FIG. 4, so the projection 15 is disposed to the left of the end part 13 in FIG. 2, but is disposed to the right of the end part 13 in FIG. 4.) The inner protrusion 8 of the beam 4 is received in the corner groove 19 of the end part 13. The lower protrusion 9 of the beam 4 is received in the lower groove 21 of the end part 13. The upper protrusion 17 of the end part 13 is received in the inner groove 11 of the beam 4. The lower protrusion 18 of the end part 13 is placed below the lower protrusion 9 of the beam 4. The cooperating protrusions and grooves engage each other with a force fit. In the vertical connection between the end part 13 of the screening mat 2 and the beam 4 of the carrier 1, two protrusions 17, 18 of the end part 13 are disposed below respective protrusions 8, 9 of the beam 4.

After placing one end part of a first screening mat 2 inside the slot 6 of the carrier, the end part 13 or 14 of a second screening mat 2 is placed inside that slot 6 of the carrier 1. The corresponding protrusions and grooves of the end part 13, 14 of the second mat 2 and the beam 4, 5 of the carrier 1 cooperate in the same way as described above for the connection of the first screening mat 2 to the carrier 1.

Thus, in the slot 6 of the carrier 1, there are disposed one end part 13 of one screening mat 2 (i.e., an end part adjacent to a protection 15), and one end part 14 of another screening mat 2 (i.e., an end part having no adjacent protection). In FIG. 2, the projection 15 is placed against a side of the beam 4, 5 which faces in a direction opposite the direction of motion D of the gravel etc. Such a beam side would be susceptible to being hit by separated fractions in the absence of the protection afforded by the projection 15.

Finally, the wedge 3 is pressed down between the end parts 13, 14 of the two screening mats 2 received inside the carrier 1. Due to the wedge 3 having a thinner lower portion 24, it is easy to initially depress the wedge 3 a first distance. For the final pressing down of the wedge 3, the blow of a hammer or the like is normally used. The upper portion 23 and lower portion 24 of the wedge 3 will abut the upper parts 16 and lower parts 26, respectively, on the outside of the two screening mats 2 received in the carrier slot 6. By means of the wedge 3, the protrusions of the end parts 13, 14 are forcibly pressed into the grooves of the respective beams 4, 5, and vice-versa. Thus, by the cooperation of the grooves, the protrusions and the wedge 1, the respective ends of the two screening mats 2 are fixed to the carrier 1. The fixation is made without the use of any penetrating fastening means.

After mounting, the inner protrusions 8 and lower protrusions 9 of the beams 4, 5 and the upper protrusions 17 and lower protrusions 18 of the end parts 13, 14 of the screening mats 2 are placed abutting each other at alternating heights. For each contact surface between a beam 4, 5 and an end part 13, 14 the inner protrusion 8 of the beam 4, 5 is placed uppermost followed sequentially downwardly by: the upper protrusion 17 of the end part 13, 14, the lower protrusion 9 of the beam, and finally the lower protrusion 18 of the end part 13, 14.

A person skilled in the art will realize that the exact form and placement of the protrusions and grooves of the end parts 13, 14 of the screening mats 2 and the beams 4, 5 of the carriers 1 may vary. However, it is beneficial if at least two protruding parts of the end parts 13, 14 of the screening mats 2 and the beams 4, 5 of the carriers 1, respectively, are placed under, and in abutting relationship with, two protruding parts of the adjacent beam 4, 5 and end part 13, 14, respectively.

The screening mats 2 may be fabricated by an extrusion operation and reinforced by means of fibres integrated in the extrusion material. The apertures of the screening mats 2 are preferably formed by punching. Normally, the extruded screening mats 2 are relatively long and may be transported and stored in a coiled form. In time of use, an appropriate length of the screening mat is unrolled and then cut in a direction perpendicular to the longitudinal extension of the end parts 13, 14. The extruded and cut screening mats 2 are recyclable.

It will be appreciated that when a screening mat 2 becomes worn, it is merely necessary to remove the wedges 3 retaining the mat in adjacent carriers 1, in order to release the worn mat for replacement by a new mat.

Although the invention has been described as useful in the retrofitting of existing vibrating screen devices, it is also applicable to the construction of new vibrating screen devices.

A person skilled in the art will realize that the features of the embodiment described may be combined in many different ways, and that additions, deletions, modifications and substitutions not specifically described may be made without departing from the spirit and scope of the invention defined in the appended claims.

The disclosures in the Swedish patent application No. 1050201-1, from which this application claims priority, are incorporated herein by reference.

What is claimed is:

1. A vibrating screen device for fractionizing stones and gravel, comprising:

a plurality of carriers and a plurality of screening mats removably mounted on the carriers in side-by-side relationship, each screening mat having opposite end parts directed downwards from the screening mat a first distance and a projection located between and asymmetrically spaced apart from the opposite end parts and directed downwards from the screening mat a second distance, the second distance being greater than the first distance of the end part located closest to the projection, wherein respective end parts of two adjacent screening mats are received in each carrier, and wherein a first surface of the projection contacts an outer surface of the carrier.

2. The vibrating screen device as claimed in claim 1, further including a support structure for supporting the carriers, wherein each carrier has a lengthwise direction and includes two upright beams extending in said lengthwise direction and forming a slot therebetween, and wherein respective end parts of two adjacent screening mats are disposed in the slot.

3. The vibrating screen device as claimed in claim 2, wherein each of the beams includes a plurality of protrusions and grooves, and wherein each of the end parts disposed in the slot includes a plurality of protrusions and grooves connected to the grooves and protrusions, respectively, of the beams.

4. The vibrating screen device as claimed in claim 3, wherein the protrusions and grooves of the end parts extend substantially the entire length of the end parts, wherein the protrusions and grooves of the beams extend substantially the entire length of the beams, and wherein the connection between each end part and its respective beam includes two protrusions on one of said end part and beam abutting, from below, respective protrusions of the other of said end part and beam from below.

5. The vibrating screen device as claimed in claim 4, wherein the slot is formed by two mutually facing surfaces of the beams, each of the mutually facing surfaces having an inner protrusion and a lower protrusion, with an inner groove disposed therebetween, and wherein each end part disposed in the slot has an upper protrusion and a lower protrusion, with a lower groove formed therebetween.

6. The vibrating screen device as claimed in claim 5, wherein the inner and lower protrusions of each beam, and the upper and lower protrusions of each end part are disposed in abutting relationship at alternating heights, and wherein, in each connection between a beam and an end part, the inner protrusion of the beam is disposed uppermost, followed sequentially downwardly by: the upper protrusion of the end part, the lower protrusion of the beam, and the lower protrusion of the end part.

7. The vibrating screen device as claimed in claim 2, wherein an elongated wedge is removably disposed in the slot between the end parts to retain the connection between the end part and the beam.

8. The vibrating screen device as claimed in claim 7, wherein the wedge includes upper and lower portions, the lower portion being thinner than the upper portion, wherein each end part disposed in the slot has an outer surface facing the wedge, the outer surface including upper and lower parts abutting the upper and lower portions, respectively of the wedge, and wherein the lower portion of the wedge includes longitudinal crests frictionally engaging the lower parts of both outer surfaces.

9. The vibrating screen device as claimed in claim 7, wherein the end parts include a plurality of protrusions and grooves that extend substantially the entire length of the end parts, wherein the beams include a plurality of protrusions and grooves that extend substantially the entire length of the beams, and wherein the connection between each end part and its respective beam includes two protrusions on one of said end part and beam abutting, from below, respective protrusions of the other of said end part and beam, the end parts of the screening mats being held in the respective slot by cooperation between the protrusions and grooves of the end parts and the respective beams, and the wedge.

10. The vibrating screen device as claimed in claim 2, wherein each screening mat includes a projection extending downwardly at a distance from one of the end parts, which distance corresponds substantially to the thickness of a beam of the carrier.

11. The vibrating screen device as claimed in claim 10, wherein the projection extends substantially the entire length of the screening mat and is arranged to face in a direction generally opposite a direction of travel of stones and gravel along the device, to shield a respective beam of the carrier from contact therewith.

12. The vibrating screen device as claimed in claim 1, wherein each screening mat includes a lengthwise direction oriented transversally relative to a direction of travel of stones and gravel along the device.

13. The vibrating screen device as claimed in claim 2, wherein a longitudinal direction of the support structure is transverse to a lengthwise direction of the carriers that it supports.

14. The vibrating screen device as claimed in claim 1, wherein the opposite end parts on each screening mat are mirror images of each other.

15. The vibrating screen device as claimed in claim 2, wherein the outer surface of the carrier contacted by the projection is an outer surface of a first of the two upright beams.

16. The vibrating screen device as claimed in claim 15, wherein the first upright beam is received into a space between the projection and the end part located closest to the projection.

17. The vibrating screen device as claimed in claim 15, wherein the projection protects the outer surface of the first upright beam from particles coming through the screening mat.

* * * * *